US012529548B2

(12) United States Patent
Wells

(10) Patent No.: US 12,529,548 B2
(45) Date of Patent: Jan. 20, 2026

(54) STABILIZERS FOR AERIAL PROJECTILES

(71) Applicant: Tim Wells, Canton, MI (US)

(72) Inventor: Tim Wells, Canton, MI (US)

( * ) Notice: Subject to any disclaimer, the term of this patent is extended or adjusted under 35 U.S.C. 154(b) by 0 days.

(21) Appl. No.: 19/217,117

(22) Filed: May 23, 2025

(65) Prior Publication Data

US 2025/0369735 A1 Dec. 4, 2025

Related U.S. Application Data

(60) Provisional application No. 63/655,546, filed on Jun. 3, 2024.

(51) Int. Cl.
*F42B 10/26* (2006.01)

(52) U.S. Cl.
CPC ..... *F42B 10/26* (2013.01)

(58) Field of Classification Search
CPC ..... F42B 10/26; F42B 10/06; F42B 6/02
See application file for complete search history.

(56) References Cited

U.S. PATENT DOCUMENTS

| | | | | |
|---|---|---|---|---|
| 3,081,703 A * | 3/1963 | Kamp | F42B 10/02 102/388 |
| 5,971,875 A * | 10/1999 | Hill | F42B 10/26 473/578 |
| 2015/0354932 A1* | 12/2015 | Schnabel | F42B 10/24 102/501 |
| 2023/0044162 A1* | 2/2023 | Maurer | F42B 5/025 |

* cited by examiner

*Primary Examiner* — Valentina Xavier

(57) ABSTRACT

A stabilizer for an aerial projectile comprises a conical portion with a first longitudinal axis, a first end of a lesser diameter, and a second end of a greater diameter. A tubular portion having a second longitudinal axis is coaxially conjoined at the first end of the conical portion. An external surface of the conical portion is engrailed or invected by a radial succession of flutes alternating with a radial succession of splines. For invected surfaces, at least a portion of any one flute from among the radial succession of flutes may comprise a planar surface. The surfaces of the flutes and splines may be longitudinally straight or may be helical surfaces. The stabilizer may be made of plastic and a portion of the plastic may be a recycled plastic material.

16 Claims, 5 Drawing Sheets

G – G

STABILIZERS FOR AERIAL PROJECTILES

CROSS REFERENCE TO RELATED APPLICATION

This non-provisional utility patent application claims the benefit of and priority to U.S. Provisional Patent Application Ser. No. 63/655,546 "Stabilizers for Aerial Projectiles," filed 3 Jun. 2024. The entire contents of U.S. Provisional Patent Application Ser. No. 63/655,546 "Stabilizers for Aerial Projectiles," filed 3 Jun. 2024 are hereby incorporated into this document by reference.

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The invention relates to improvements in traditionally fin-stabilized projectiles such as archery arrows, crossbow bolts, darts thrown by hand or expelled from a blowgun, and flechettes.

BACKGROUND

Fin-stabilized projectiles typically include archery arrows, crossbow bolts, darts thrown by hand or expelled from a blowgun, and flechettes. The typical projectile is a long beam, and typically of a round cross section such as a rod or a tube, and defines a longitudinal axis, a tip or a point at a first end, and a tail at a second end opposite the first end.

Tips or points of these projectiles are fashioned having many different shapes and features specific to the purpose of various types of projectiles. Projectile points are outside the scope of the invention. The tails of these projectiles usually comprise a radially spaced apart array of vanes or membranes oriented parallel to the longitudinal axis of the projectile. Many of the traditional or typical constructions for tail-mounted stabilizers are fragile, such as feather fletches in particular. Even synthetic replacements for bird feathers mounted on arrows and darts and the like are fragile and often expensive.

Further challenges are involved in procuring a set of identical fletches for a radial array, such as cutting a set of membranes so that they all have identical profiles, and precise repetitions of mounting tasks are required, not only to locate each fin or fletch in the set at the same longitudinal position on the shaft of the projectile but also to place each member of the set at equally angularly spaced apart locations around the shaft. Mounting or replacing these elements requires skill and often also requires specialized alignment tools or mounting "jigs."

All this work may be lost by dropping an arrow or dart on the ground, by having an arrow or dart fail to remain embedded in a target and fall to the ground, or by embedding an arrow or dart into a target object which gets displaced by the impulse energy of the projectile impact so that it rolls over and allows the fletching of the embedded projectile to become damaged by contact the ground or other nearby surfaces.

Furthermore, adhesives for affixing fletches to the shaft may be messy to work with, or have objectionable odors or hazardous or volatile vapors associated with them. Also, adhesives take time to set up or "cure," and some may fail if exposed to moisture. A projectile stabilizer or installation method therefor that is quick and easy and impervious to water in its environment of use would be advantageous and desirable.

BRIEF DESCRIPTION

The invention disclosed herein is primarily intended for sports and activities which use fin-stabilized projectiles attached to a tail end of a longitudinal shaft of the projectile. The scope of the invention does not include tips or points of the projectile.

Therefore a primary objective of the invention is to provide a single object that provides an effective set of radially symmetric stabilizing surfaces for such a projectile, so that mounting this object by the tail of the projectile shaft eliminates having to both longitudinally and radially align a plurality of objects that provide individual stabilizing surfaces. A corollary objective of the invention is to eliminate the need to collect a set of similar but non-identical fin-stabilizing objects and to either select the most identical of these and discard the outliers to waste, or to attempt to shape each element of a candidate set so that they conform acceptably within a profile tolerance and an acceptable range of mass.

Another objective of the invention is to provide a stabilizing object for a projectile that resists damage upon contact with the ground or other surfaces.

Yet another corollary objective of the invention is to provide a stabilizing object for a projectile which may be installed on the shaft thereof without requiring special alignment tools, exacting skills, or messy or odorous adhesives. A corollary advantage of the invention is that such an object may be readily exchanged from the shaft of one projectile to the shaft of another. Another corollary objective of the invention is that the means for attachment are impervious to environmental moisture.

Another objective of the invention is to provide a stabilizing object installable onto a projectile which is made of an inexpensive material, and a corollary objective of the invention is that the material for this object is also a recyclable material.

BRIEF DESCRIPTION OF THE DRAWINGS

A further understanding of the nature and advantages of particular embodiments may be realized by reference to the remaining portions of the specification and the drawings, in which like reference numerals are used to refer to similar components. When reference is made to a reference numeral without specification to an existing sub-label, it is intended to refer to all such multiple similar components.

DETAILED DESCRIPTION of CERTAIN EMBODIMENTS

Figure 1A:
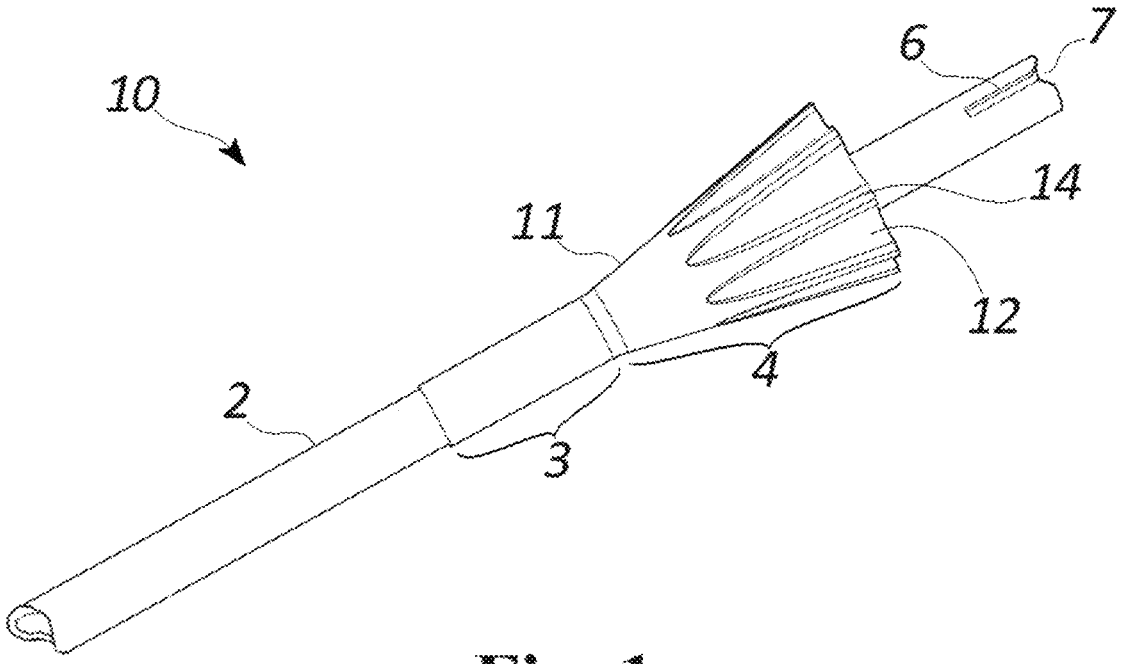
FIG. 1*a* shows an oblique view of a tail portion of the shaft of an aerial projectile fitted with one type of preferred embodiment of a stabilizer in accordance with the invention.

While various aspects and features of certain embodiments have been summarized above, the following detailed description illustrates a few exemplary embodiments in further detail to enable one skilled in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the present invention may be practiced without some of these specific details. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

In this application the use of the singular includes the plural unless specifically stated otherwise, and use of the terms "and" and "or" is equivalent to "and/or," also referred to as "non-exclusive or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise. Where grammatical genders are concerned, a "user" of the invention may be of any gender regardless of any specific pronouns or grammar used in this specification. Thus, masculine grammatical forms may be interpreted to include and subsume feminine or any other grammatical genders.

The invention is a stabilizer for an aerial projectile that comprises a conical portion with a first longitudinal axis, a first end of a lesser diameter, and a second end of a greater diameter. A tubular portion having a second longitudinal axis is coaxially conjoined at the first end of the conical portion. An external surface of the conical portion is engrailed or invected by a radial succession of flutes alternating with a radial succession of splines. For invected surfaces, at least a portion of any one flute from among the radial succession of flutes may comprise a planar surface. The surfaces of the flutes and splines may be longitudinally straight or may be helical surfaces. The stabilizer may be made of plastic and a portion of the plastic may be a recycled plastic. The device may be easily and readily installed onto a rod or tube that serves as a shaft for an arrow, a dart, a bolt, or a flechette, or any similar aerial projectile. However, in most preferable embodiments the invention is sized for archery use on arrow shafts.

Referring now to the figures, FIG. 1*a* shows an oblique view of a tail portion of the shaft of an aerial projectile [10] fitted with one type of preferred embodiment of a stabilizer in accordance with the invention. The tail portion of the shaft [2] is shown with a nock [6] for a bow or crossbow string and the nock may include lead-in [7] features such as fillets or chamfers. The stabilizer is formed with a conical portion [4] and a tubular portion [3] coaxially conjoined to the small end of the conical portion. It may be formed in plastic or other somewhat ductile material so that an interference fit between the inner wall of the tubular portion fits snugly onto the projectile shaft. An external surface of the conical portion is engrailed by a radial succession of flutes [12] alternating with a radial succession of splines [14.] Tubes and conical objects inherently define central axes and these are not ubiquitously illustrated in all figures of this application. The tail end of the conical section has a scalloped perimeter distinct from products designed to be launched from within a tube by air pressure delivered from behind the cone, such as blow gun darts. Tail cone devices for blow gun darts terminate with a circular perimeter to create an effective air seal between the rim of the tail cone and the inner cylindrical wall of the tube.

Figure 1B:
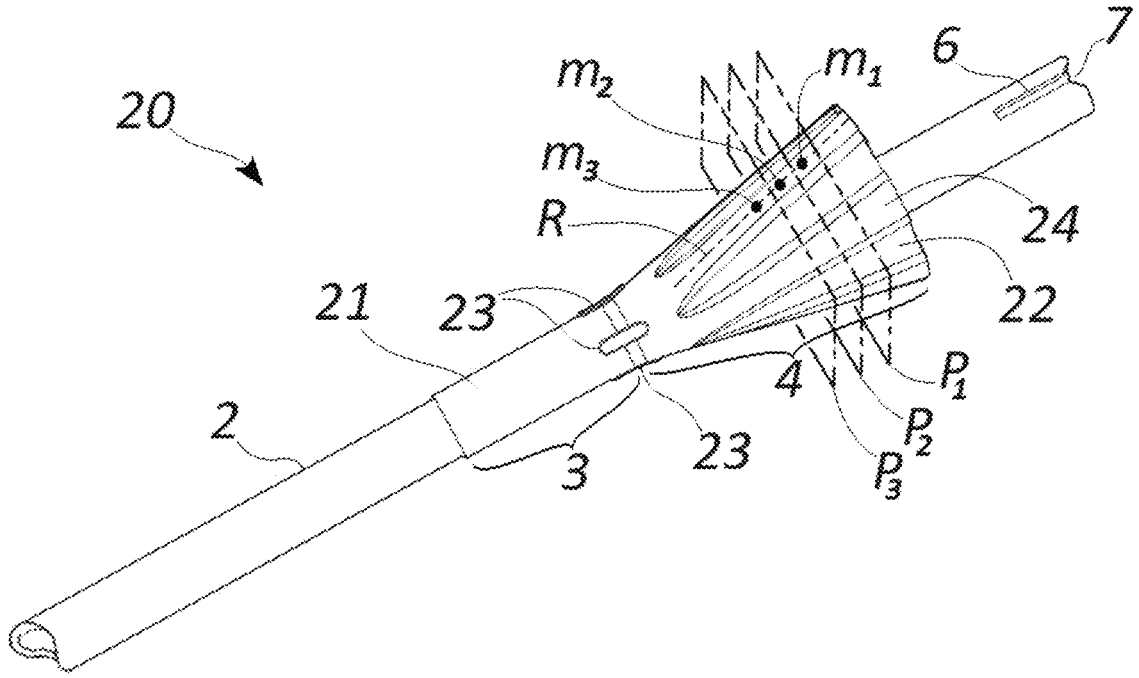
FIG. 1*b* shows an oblique view of a tail portion of the shaft of an aerial projectile fitted with an alternative type of preferred embodiment of a stabilizer in accordance with the invention.

FIG. 1*b* shows an oblique view of a tail portion of the shaft of an aerial projectile [20] fitted with an alternative type of preferred embodiment of a stabilizer [21] in accordance with the invention. The tail portion of the shaft [2] is shown with a nock [6] for a bow or crossbow string and the nock may include lead-in [7] features such as fillets or chamfers. The tubular portion [3] is coaxially conjoined to the conical portion [4.] Additional features [23] at the junction of the tubular portion and the conical portion, such as a radial array of auxiliary ribs [23,] may be included in this component for improved mold flow if the part is to be manufactured by injection molding. An external surface of the conical portion is engrailed by a radial succession of helical twisted flutes [22] alternating with a radial succession of helically splines [24.]

A uniformly spaced apart succession of planes [$P_1$], [$P_2$,] and [$P_3$] may be defined oriented perpendicular to the second longitudinal axis of the conical portion and residing longitudinally between the first and second ends of the conical portion. Each spline defines a medial ridge [R,] and once such medial ridge is shown on a first from among the radial succession of helical splines. In this view, point [$m_1$] is an intercept point where the medial ridge passes through a first plane [$P_1$,] point [$m_2$] is an intercept point where the medial ridge passes through a second plane [$P_2$,] and point [$m_3$] is an intercept point where the medial ridge passes through a third plane [$P_3$.]

Figure 2A:
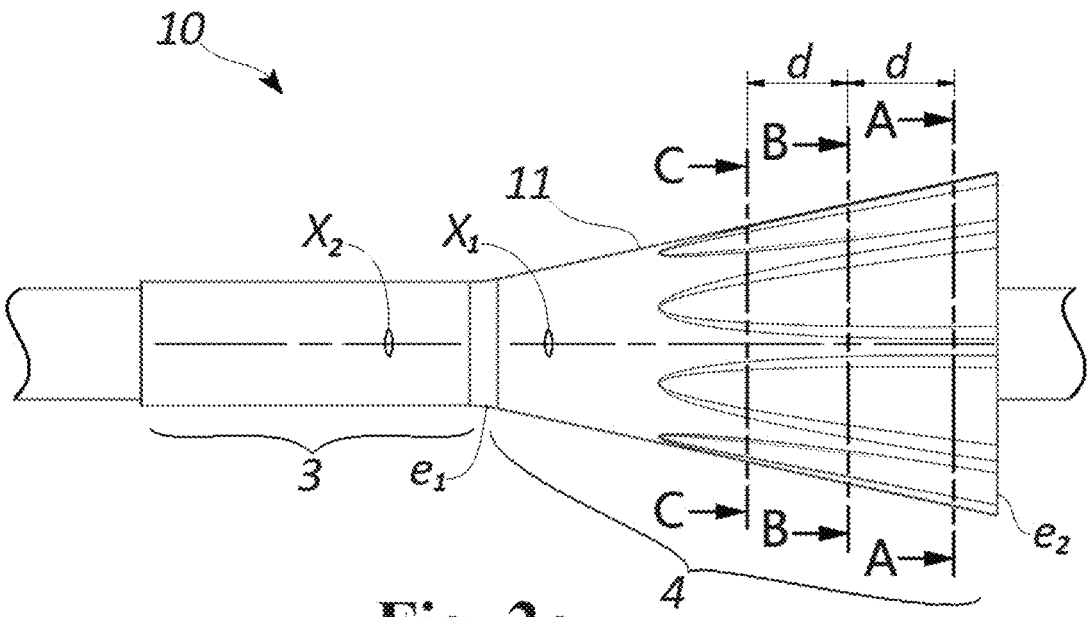
FIG. 2*a* shows a side view of the tail portion of the shaft of an aerial projectile and the stabilizer of FIG. 1*a*, and defines three section lines A-A, B-B, and C-C, evenly spaced apart and cutting through a conical portion of this stabilizer.

FIG. 2*a* shows a side view of the tail portion of the shaft of an aerial projectile [10] and the stabilizer of FIG. 1*a*, and defines three section lines A-A, B-B, and C-C, evenly spaced apart and cutting through a conical portion of this stabilizer [11.] In this view the cutting planes for the section views are evenly spaced apart by a distance [d.] The stabilizer comprises a conical portion [4] having a first longitudinal axis [$X_1$,] and the conical portion has a first end [e1] of a lesser diameter and a second end [e2] of a greater diameter. A tubular portion [3] having a second longitudinal axis [$X_2$] is coaxially conjoined at the first end of the conical portion.

Figure 2B:
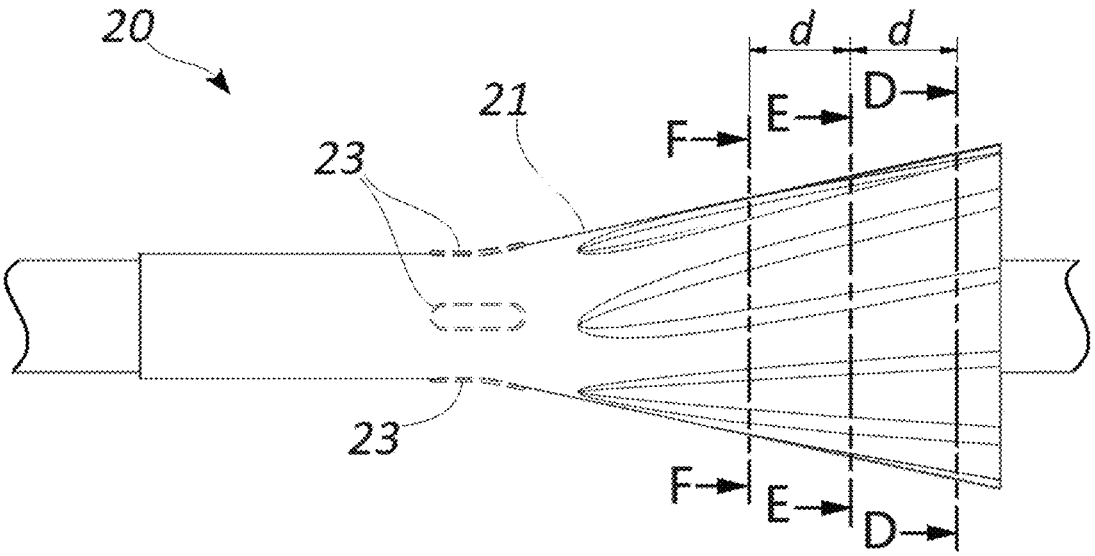
FIG. 2*b* shows a side view of the tail portion of the shaft of an aerial projectile and the stabilizer of FIG. 1*b*, and defines three section lines D-D, E-E, and F-F, evenly spaced apart and cutting through a conical portion of this stabilizer.

FIG. 2*b* shows a side view of the tail portion of the shaft of an aerial projectile [20] and the stabilizer of FIG. 1*b*, and defines three section lines D-D, E-E, and F-F, evenly spaced apart and cutting through a conical portion of this stabilizer [21.] In this view the cutting planes for the section views are evenly spaced apart by the same distance [d] as is seen in FIG. 2*a*. The flutes and splines of this embodiment are helical features. The additional features [23] at the junction of the tubular portion and the conical portion, typically included to improve mold flow in injection molding, are optional and are shown in broken lines as they may not be present in all embodiments within the scope of the invention. For example, the stabilizer may be produced by 3D printing which would not require mold flow features at all.

Figure 3A:
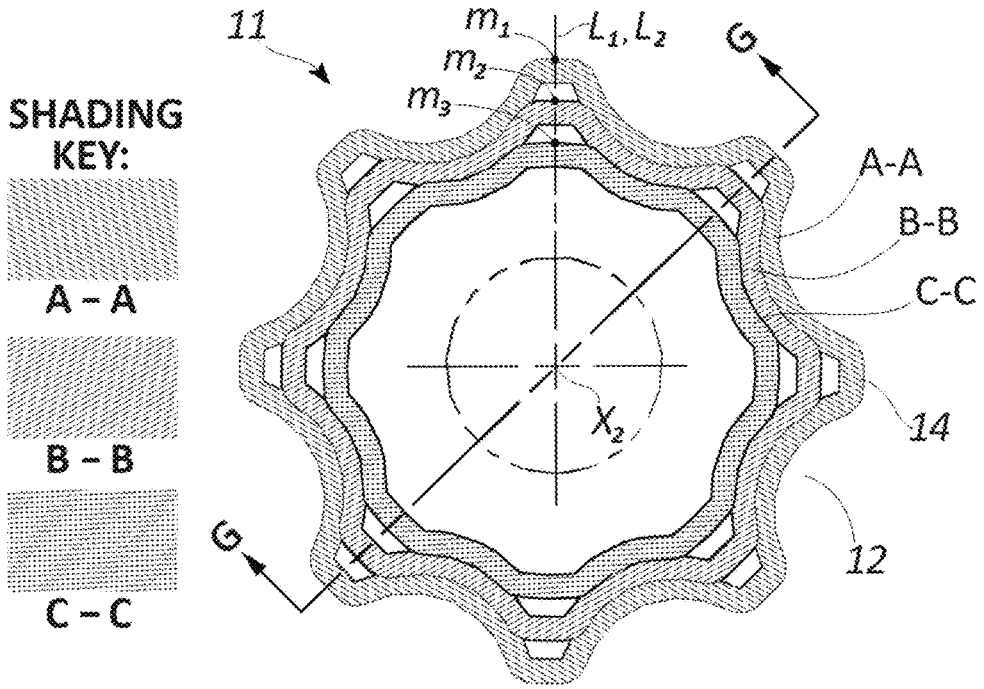
FIG. 3*a* shows the three cross sections of the stabilizer of FIG. 1*a* with sections C-C, B-B, and A-A as defined in FIG. 2*a* superimposed upon each other, and this view also defines section line G-G for the longitudinal cross section view of FIG. 4.
Figure 4:
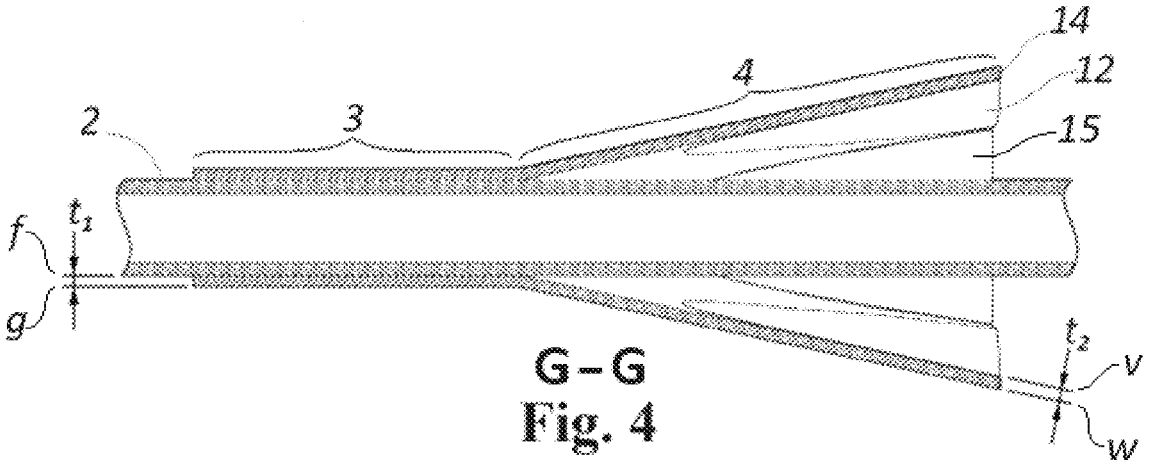
FIG. 4 shows a cross section view of a stabilizer in accordance with the invention taken at section line G-G as defined in FIG. 3*a*.

FIG. 3*a* shows the three cross sections of the stabilizer [11] of FIG. 1*a* with sections C-C, B-B, and A-A as defined in FIG. 2*a* superimposed upon each other, and this view also defines section line G-G for the longitudinal cross section view of FIG. 4. A shading key is included to identify each cross section by its own crosshatching. The external surface of the conical portion is engrailed by a radial succession of flutes [12] alternating with a radial succession of splines [14.] In this version of the stabilizer the flutes and splines remain radially aligned as the cross sections proceed from back to front as they are superimposed. Therefore, a helix angle of zero may be defined between a first line [$L_1$] in a first plane from among the succession of planes and a second line [$L_2$] in a second plane from among the succession of planes. A first point in the first line is an intercept point where the second longitudinal axis [$X_2$] passes through the first plane and a first point in the second line [$L_2$] is an intercept point where the second longitudinal axis passes through the second plane. In this embodiment and in this figure shown, the second longitudinal axis is the center point of the three superimposed cross sections, and the first point in the first line and the first point in the second line are also coincident.

A second point in the first line is defined as an intercept point where the medial ridge of a first from among the succession of splines passes through the first plane, and a second point in the second line is an intercept point where this medial ridge passes through the second plane. Thus if successive cutting planes A-A and B-B of FIG. 2*a* are used, then the second point in the first line would be point [$m_1$] and the second point in the second line would be point [$m_2$.] Alternatively if successive cutting planes B-B and C-C of FIG. 2*a* are used, then the second point in the first line would be point [$m_2$] and the second point in the second line would be point [$m_3$.] In either of these cases, line [$L_1$] lies coincident with line [$L_2$] and the helix angle of this embodiment is zero.

Figure 3B:
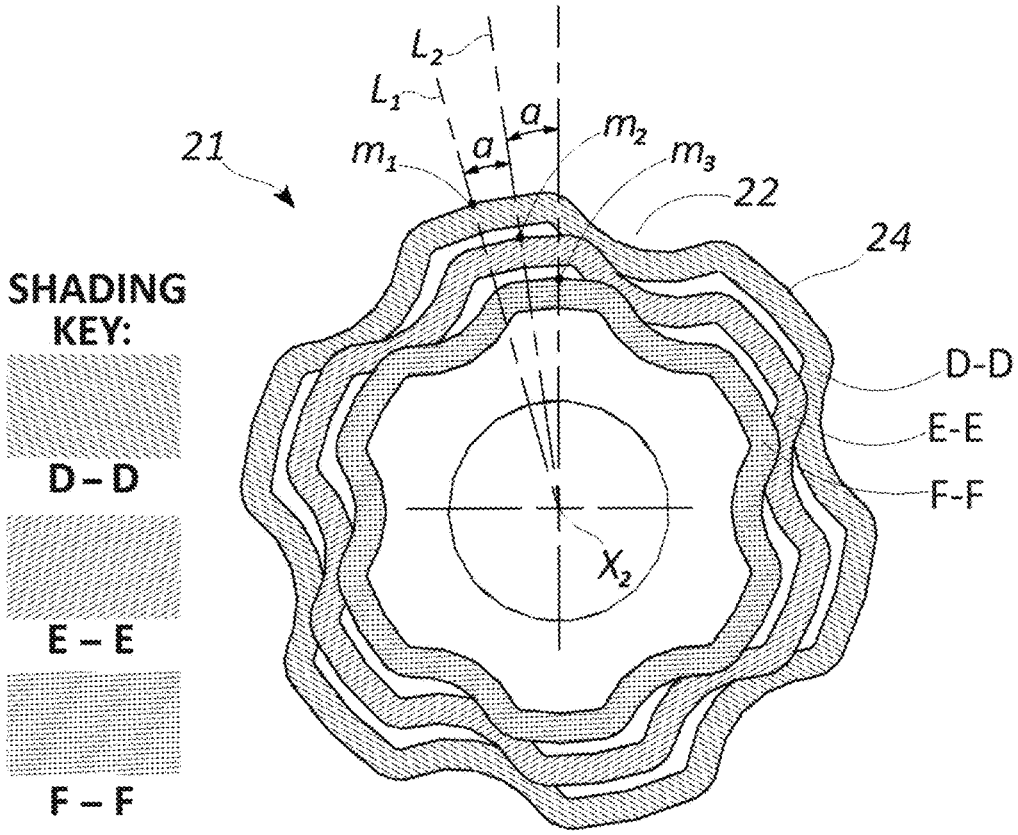
FIG. 3*b* shows the three cross sections of the stabilizer of FIG. 1*b* with sections F-F, E-E, and D-D as defined in FIG. 2*b* superimposed upon each other to illustrate how the angular displacement of the engrailed features seen in this combined cross section view accumulate along the length of the projectile axis to produce helical flutes and splines in the conical portion of the stabilizer.

FIG. 3*b* shows the three cross sections of the stabilizer [21] of FIG. 1*b* with sections F-F, E-E, and D-D as defined in FIG. 2*b* superimposed upon each other to illustrate how the angular displacement of the engrailed features seen in this combined cross section view accumulate along the length of the projectile axis to produce helical flutes [22] and splines in the conical portion of the stabilizer. A shading key is included to identify each cross section by its own cross-hatching. In this version of the stabilizer the flutes and splines progress radially as the cross sections proceed from back to front as they are superimposed. Therefore, a helix angle may be defined between a first line [$L_1$] in a first plane from among the succession of planes and a second line [$L_2$] in a second plane from among the succession of planes. The external surface of the conical portion is engrailed by a radial succession of flutes alternating with a radial succession of splines.

A local helix angle may be defined between a first line in a first plane from among the succession of planes and a second line in a second plane from among a succession of planes such as [$P_1$,] [$P_2$,] and [$P_3$] of FIG. 1*b* or section lines D-D, E-E, and F-F of FIG. 2*b*. A first point in a first line [$L_1$] is an intercept point where the second longitudinal axis [$X_2$] passes through the first plane, and a first point in a second line [$L_2$] is an intercept point where the second longitudinal axis passes through the second plane. A second point [$m_1$] in the first line is an intercept point where the medial ridge of a first from among the succession of splines (such as [R] of FIG. 1*b*) passes through the first plane, and a second point [$m_2$] in the second line is an intercept point where the medial ridge passes through the second plane.

A helix angle may be defined as the angle [a] between [$L_1$] and [$L_2$] with the first plane superimposed upon the second plane. If the helix angle is constant, and the spacing between successive cross sections is also constant then a successive line passing though intercept point [$m_3$] and longitudinal axis [$X_2$] would also subtend an angle [a] from [$L_2$.]

In this figure line [$L_1$] is distinct from [$L_2$] and so the value of angle [a] is other than zero and thus an absolute value of the helix angle is greater than zero. It will be appreciated by the reader that the definitions and methods used for determining a helix angle for the features of this invention differ from the methods of determining a helix angle in other objects such as screw threads, power threads, or helical coils in springs.

FIG. 4 shows a cross section view of a stabilizer in accordance with the invention taken at section line G-G as defined in FIG. 3*a*. The tubular portion [3] of the stabilizer defines a first external surface [g] and a first internal surface [f] separated by a first material thickness [$t_1$,] and the external surface [w] of a flute [12] of the conical portion [4] is separated from an internal surface [v] of a cavity [15] within the conical portion by a second material thickness [$t_2$.] In preferable embodiments the material wall thickness of the tubular portion is within about 20% of the wall thickness of a flute, so that a quotient defined as the first material thickness divided by the second material thickness would reside inclusively within a range from about 0.78 to about 1.23.

In preferable embodiments the stabilizer may be made of a plastic material and such a plastic may include at least 20% of recycled plastic material. Flexible and ductile plastic materials such as natural, butyl, or urethane rubber, polyamide (nylon,) acrylonitrilebutadiene-styrene (ABS,) and polypropylene may be preferred over rigid or brittle materials. The inventive product may be molded in any colors. An advantage of using soft materials is that the material will deform or "give in" while crossing the arrow rest of a bow and will also flex during flight, this keeping an arrow flying along a straight trajectory. This benefit also produces a corollary benefit of the arrow's flight being less susceptible to deviations caused by crosswinds.

Figure 5:
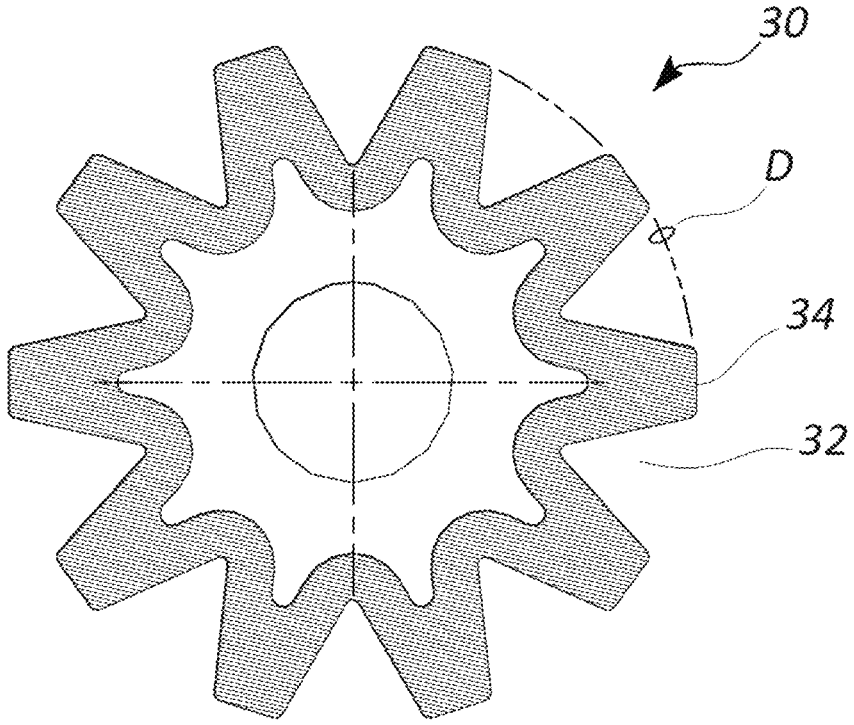
FIG. 5 shows a cross section view of an alternative embodiment of a stabilizer in accordance with the invention taken at any cross section plane from among such planes as [$P_1$,] [$P_2$,] or [$P_3$] as seen in FIG. 1*b*, and in which the fluted surfaces are invected rather than engrailed.

FIG. 5 shows a cross section view of an alternative embodiment [30] of a stabilizer in accordance with the invention taken at any cross section plane from among such planes as [$P_1$,] [$P_2$,] or [$P_3$] as seen in FIG. 1*b*, and in which the fluted surfaces are invected rather than engrailed. The difference between an engrailed surface and an invected surface is that a cross section of an engrailed surface would usually comprise only curved or arcuate profiles, whereas an invected surface may also comprise one or more planar surfaces. An engrailed surface appears as a surface having a series of grooves which have rounded floors and may also be called "scalloped."

An invected surface may have series of V-notches [32] or pairs of mutually facing dihedral surfaces. Thus a stabilizer in accordance with the invention may include a conical portion invected by a radial succession of flutes alternating with a radial succession of splines, wherein at least a portion of any one flute from among the radial succession of flutes comprises a planar surface.

According to other alternative embodiments within the scope of the invention, rather than having a conical surface which in cross section would follow a circular perimeter such as [D] in this figure, the splines may include planar surfaces as well, so that an external surface of at least one from among the radial succession of splines comprises a planar surface [34.]

Figure 6:
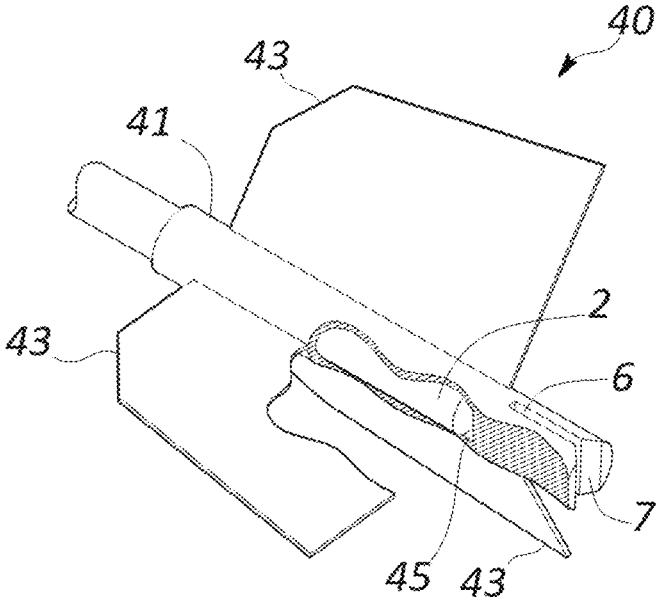
PRIOR ART Fig. 6
FIG. 6 shows an oblique rear view of a stabilizer product distinct from the invention, and shown with a partially broken-out section.

FIG. 6 shows an oblique rear view of a stabilizer product distinct from the invention, and shown with a partially broken-out section. Similar products distinct from the invention have a finned body with a nock at its rear and a barbed nose for inserting into and connecting to the end of a tube used as an arrow shaft. These products are distinct from and outside the scope of the invention. In the distinct product [40] shown, a hollow tube body [41] has a solid end with a nock [6] and chamfers [7] leading to the nock. The tube has an internal cavity [45] into which the arrow shaft [2] inserts. A radial array of fins [43] are attached around the exterior of the tube.

The limitation of this sort of product, or its equivalent having a barbed stub that inserts into the end of a tubular arrow shaft, is that these products may only be attached at the end of the arrow shaft. In comparison, a stabilizer in accordance with the invention may be slid along the arrow shaft near its end, but not necessarily only at the end of the arrow.

Also in contrast to the finned products, a stabilizer in accordance with the invention embodies a cone cut into by a radially spaced apart series of grooves or flutes, which may be longitudinal features or helical features which impart spin stabilization to the arrow in flight.

While certain features and aspects have been described with respect to exemplary embodiments, one skilled in the art will recognize that numerous modifications are possible. Also, while certain functionality is ascribed to certain system components, unless the context dictates otherwise, this functionality may be distributed among various other system components in accordance with the several embodiments.

Moreover, while the procedures of the methods and processes described herein are described in a particular order for ease of description, unless the context dictates otherwise, various procedures may be reordered, added, and/or omitted in accordance with various embodiments. Furthermore, the procedures described with respect to one method or process may be incorporated within other described methods or processes; likewise, system components described according to a particular structural configuration and/or with respect to one system may be organized in alternative structural configurations and/or incorporated within other described systems.

The present disclosure is not to be limited in terms of the particular embodiments described in this application, which are intended as illustrations of various aspects. Many modifications and variations can be made without departing from its spirit and scope. Functionally equivalent methods and apparatuses within the scope of the disclosure, in addition to those enumerated herein, are possible from the foregoing descriptions. Such modifications and variations are intended to fall within the scope of the appended claims. The present disclosure is to be limited only by the terms of the appended claims, along with the full scope of equivalents to which such claims are entitled.

Hence, while various embodiments are described with or without certain features for ease of description and to illustrate exemplary aspects of those embodiments, the various components and/or features described herein with respect to a particular embodiment may be substituted, added, and/or subtracted from among other described embodiments, unless the context dictates otherwise. Thus, unauthorized instances of apparatuses and methods claimed herein are to be considered infringing, no matter where in the world they are advertised, sold, offered for sale, used, possessed, or performed.

Consequently and in summary, although many exemplary embodiments are described above, it will be appreciated that the invention is intended to cover all modifications and equivalents within the scope of the following claims.

What is claimed is:

1. A stabilizer for an aerial projectile comprising a conical portion having a first longitudinal axis, a first end of a lesser diameter and a second end of a greater diameter, and a tubular portion having a second longitudinal axis and coaxially conjoined to said first longitudinal axis at said first end of said conical portion, with an external surface of said conical portion engrailed by a radial succession of flutes alternating with a radial succession of splines.

2. The stabilizer of claim 1, wherein a uniformly spaced apart succession of planes perpendicular to said second longitudinal axis and residing longitudinally between said first and second ends of said conical portion to define a helix angle between a first line in a first plane from among said succession of planes and a second line in a second plane from among said succession of planes, wherein a first point in said first line is an intercept point where said second longitudinal axis passes through said first plane, a first point in said second line is an intercept point where said second longitudinal axis passes through said second plane, a second point in said first line is an intercept point where said medial ridge of a first from among said succession of splines passes through said first plane, and a second point in said second line is an intercept point where said medial ridge passes through said second plane, and said helix angle is defined with said first plane superimposed upon said second plane.

3. The stabilizer of claim 2, wherein said helix angle is zero.

4. The stabilizer of claim 2, wherein an absolute value of said helix angle is greater than zero.

5. The stabilizer of claim 1, wherein said tubular portion defines a first external surface and a first internal surface separated by a first material thickness, an external surface of any from among said radial succession of flutes of said conical portion is separated from an internal surface of a cavity within said conical portion by a second material thickness, and a quotient defined as said first material thickness divided by said second material thickness resides inclusively within a range from about 0.78 to about 1.23.

6. The stabilizer of claim 1, wherein said stabilizer is made of a plastic material.

7. The stabilizer of claim 6, wherein plastic material comprises at least 20% of a recycled plastic material.

8. The stabilizer of claim 1, wherein an external surface of at least one from among said radial succession of splines comprises a planar surface.

9. A stabilizer for an aerial projectile comprising a conical portion having a first longitudinal axis, a first end of a lesser diameter, and a second end of a greater diameter, and a tubular portion having a second longitudinal axis and coaxially conjoined at said first end of said conical portion, with an external surface of said conical portion invected by a radial succession of flutes alternating with a radial succession of splines, wherein at least a portion of any one flute from among said radial succession of flutes comprises a planar surface.

10. The stabilizer of claim 9, wherein a uniformly spaced apart succession of planes perpendicular to said second longitudinal axis and residing longitudinally between said first and second ends of said conical portion to define a helix angle between a first line in a first plane from among said succession of planes and a second line in a second plane from among said succession of planes, wherein a first point in said first line is an intercept point where said second longitudinal axis passes through said first plane, a first point in said second line is an intercept point where said second longitudinal axis passes through said second plane, a second point in said first line is an intercept point where said medial ridge of a first from among said succession of splines passes through said first plane, and a second point in said second line is an intercept point where said medial ridge passes through said second plane, and said helix angle is defined with said first plane superimposed upon said second plane.

11. The stabilizer of claim 10, wherein said helix angle is zero.

12. The stabilizer of claim 10, wherein an absolute value of said helix angle is greater than zero.

13. The stabilizer of claim 9, wherein said tubular portion defines a first external surface and a first internal surface separated by a first material thickness, an external surface of any from among said radial succession of flutes of said conical portion is separated from an internal surface of a cavity within said conical portion by a second material thickness, and a quotient defined as said first material thickness divided by said second material thickness resides inclusively within a range from about 0.78 to about 1.23.

14. The stabilizer of claim 9, wherein said stabilizer is made of a plastic material.

15. The stabilizer of claim 14, wherein plastic material comprises at least 20% of a recycled plastic material.

16. The stabilizer of claim 9, wherein an external surface of at least one from among said radial succession of splines comprises a planar surface.

* * * * *